US011427231B2

(12) United States Patent
Fullerton et al.

(10) Patent No.: US 11,427,231 B2
(45) Date of Patent: Aug. 30, 2022

(54) RAIL CAR MOVER ATTACHMENT AND RELATED METHOD OF USE

(71) Applicant: AIS Construction Equipment Corporation, Grand Rapids, MI (US)

(72) Inventors: Chad Fullerton, Bay City, MI (US); Rickey D. Williams, Birch Run, MI (US)

(73) Assignee: AIS Construction Equipment Corporation, Grand Rapids, MI (US)

( * ) Notice: Subject to any disclaimer, the term of this patent is extended or adjusted under 35 U.S.C. 154(b) by 292 days.

(21) Appl. No.: 16/932,200

(22) Filed: Jul. 17, 2020

(65) Prior Publication Data

US 2022/0017124 A1 Jan. 20, 2022

(51) Int. Cl.

| | |
|---|---|
| ***B61G 1/30*** | (2006.01) |
| ***B61G 5/08*** | (2006.01) |
| ***B61G 1/28*** | (2006.01) |
| ***B61J 3/12*** | (2006.01) |

(52) U.S. Cl.

CPC ..... *B61G 1/30* (2013.01); *B61G 1/28* (2013.01); *B61G 1/286* (2013.01); *B61G 5/08* (2013.01); *B61J 3/12* (2013.01)

(58) Field of Classification Search

CPC ... B61J 3/12; B61G 1/28; B61G 1/286; B61G 1/30; B61G 5/00; B61G 5/08

USPC ..... 213/1.3

See application file for complete search history.

(56) References Cited

U.S. PATENT DOCUMENTS 3,198,137 A * 8/1965 White, Jr. ..... B60F 1/043 105/72.2
3,388,928 A * 6/1968 Poker ..... B61G 7/08 280/468
3,922,007 A * 11/1975 Friedebach ..... B61J 3/12 280/456.1

(Continued)

FOREIGN PATENT DOCUMENTS

CN 104787080 A * 7/2015

OTHER PUBLICATIONS https://en.wikipedia.org/wiki/Railcar_mover; downloaded Jul. 6, 2020.

(Continued)

*Primary Examiner* — Zachary L Kuhfuss

(74) *Attorney, Agent, or Firm* — Warner Norcross + Judd LLP

(57) ABSTRACT

A rail car mover attachment includes a remote removably mounted in a machine cab and including an emergency actuator to abruptly activate a rail car brake, a lock pin actuator to move a lock pin relative to a rail car latch in a rail car coupler, and/or a controlled stop actuator to selectively activate a rail car brake. The attachment can include an onboard compressor, such as a high volume compressor. The attachment can include a disconnect unit that self-activates rail car brakes if the attachment loses power or detaches from equipment. The attachment can include a light showing the attachment is charged and running or showing a fault. The attachment can include a laterally extending indicator arm deployable when the rail car coupler is fully attached to the rail car, and that extends beyond a rail car width so that a spotter can visually verify the coupler status. A related method of use also is provided.

20 Claims, 9 Drawing Sheets

(56) References Cited

U.S. PATENT DOCUMENTS

2013/0118374 A1* 5/2013 Meister ..... B61J 3/12
105/73

OTHER PUBLICATIONS http://www.mitchell-railgear.com/product-listing/10/207; downloaded Jul. 6, 2020.
http://www.mitchell-railgear.com/product-listing/10/19; downloaded Jul. 6, 2020.
http://www.mitchell-railgear.com/product-listing/5094/61; downloaded Jul. 6, 2020.
http://www.mitchell-railgear.com/product-listing/5094/62; downloaded Jul. 6, 2020.
http://www.mitchell-railgear.com/product-listing/5094/53; downloaded Jul. 6, 2020.
http://www.mitchell-railgear.com/product-listing/5094/37; downloaded Jul. 6, 2020.
http://www.mitchell-railgear.com/product-listing/5094/65; downloaded Jul. 6, 2020.
http://www.mitchell-railgear.com/product-listing/5094/173; downloaded Jul. 6, 2020.
http://www.mitchell-railgear.com/product-listing/5094/104; downloaded Jul. 6, 2020.
http://www.mitchell-railgear.com/product-listing/5094/64; downloaded Jul. 6, 2020.

* cited by examiner

RAIL CAR MOVER ATTACHMENT AND RELATED METHOD OF USE

BACKGROUND OF THE INVENTION

The present invention relates to rail car movers, and more particularly to a modular, self-contained rail car mover having safety features and emergency brake actuators.

In the railway industry, railway cars, also referred to herein as rail cars, are frequently detached from locomotives in yards and side tracks, and moved by other, separate equipment to designated locations. Locomotives are too large and difficult to maneuver for such car movements, which is why they are not used for such movement. A common piece of equipment for such movement is the rail car mover, which typically is a self-propelled unit having a rail car hitch coupler, a cab for an operator and an engine with sufficient power to move one or more heavy rail cars. These rail car movers many times are outfitted with rail car wheels, or smaller versions thereof, to directly ride on and precisely fit the same tracks on which the rail cars are located.

An issue with most conventional rail car movers is that they are dedicated pieces of rail car moving equipment. That is to say, they are configured to only travel on rail car tracks, and cannot be used in other capacities. In smaller train yards and secondary tracks, where rail cars are not frequently, separately moved by a rail car mover, such rail car movers are cost prohibitive. Some operators of such yards and tracks thus instead might use other machinery, such as tractors with a bumper on the front, to move rail cars around. While this works, and provides a dual purpose for the machinery, the moving equipment is not well suited for the task, and can present safety issues because the cars can be improperly moved or can run away or into other cars and equipment due to a weak connection (if any) to the machinery.

As a result, some manufacturers have developed modular attachments that can be temporarily attached to equipment to move rail cars more securely. One type of attachment is available from the applicant, AIS Construction Equipment Corporation of Grand Rapids, Mich. This rail car mover attachment can be attached to a quick attach coupler on a boom of equipment such as a frontend loader. The attachment includes a sliding frame carriage that includes a rail car coupler latch designed to couple to a corresponding latch on a rail car so the loader can move the rail car while joined with it. The attachment has a compressor that fills multiple tanks which are plumbed to the rail car coupler latch to operate that latch via a control panel that is hardwired into the loader cab for an operator to access and use when coupling the loader to a car to move it. One or more wires run from the cab to the attachment to operate it from the control panel in the cab.

While this system works satisfactorily, the electrical wiring for the control panel to work is complex, and unique to the loader to which the attachment is secured. Thus, the attachment can only work for a particular loader. When that loader is replaced or out of service, another loader, for example, of another brand, cannot easily be used in its place with the attachment. Indeed, if a new loader is used, it must be rewired and have a new control panel wired to the electrical system of the machine and to the attachment, which can be costly and result in equipment down time. The attachment also enables the loader to control and move the rail car to which it is attached, but sometimes, the loader can be mismatched to the sheer size and weight of a particular car. Accordingly, stopping the rail car under normal and emergency situations can be challenging with the machine. Further, the additional air tanks on the attachment can be subject to damage in a yard environment. If significantly damaged or punctured, such tanks can become projectiles in the yard, presenting additional safety issues. In addition, equipment with rail car movers typically is guided by a spotter. Many times, even a loader with an attachment can be diminutive when compared to the rail car it moves. Therefore, the spotter frequently has to check with the loader operator and/or visually inspect the coupling of the attachment to a car before issuing further commands to move the car, which can be time consuming, and can subject the spotter to moving around the yard a lot, possibly out of the safety view of the loader operator or other operators in the yard.

Accordingly, there remains room for improvement in the field of rail car movers, and in particular, rail car mover modular attachments for equipment.

SUMMARY OF THE INVENTION

A rail car mover attachment is provided including a remote removably mounted in a machine cab and including an emergency actuator to abruptly activate a rail car brake, a lock pin actuator to move a lock pin relative to a rail car latch in a rail car coupler, and/or a controlled stop actuator to selectively activate a rail car brake.

In one embodiment, the attachment can include a disconnect unit that self-activates rail car brakes if the attachment loses power or the attachment detaches from a piece of equipment used to move the rail car.

In another embodiment, the attachment can include a base including a carriage including a first rail car coupler having a first latch, a lock pin movably mounted relative to the first rail car coupler, and an air compressor mounted on the base adjacent the carriage. The air compressor can be a high volume air compressor negating the need for air storage tanks in some cases.

In still another embodiment, the attachment can include an air circuit in fluid communication with the air compressor and configured to convey pressurized air to a number of solenoids efficiently mounted to the base. One such solenoid can be a coupler latch solenoid joined with the air circuit and operably coupled to the lock pin to move the lock pin relative to the first latch, thereby locking or unlocking the first latch relative to a second latch of a corresponding second rail car coupler on a rail car. The lock pin can be joined with a pivoting armature that pivots about an axis, and that has a link joined with an air chamber that can move the link to urge the arm to pivot and thereby move the lock pin relative to the latch.

In yet another embodiment, the attachment can include an air line in fluid communication with the air circuit. The air line can include a fitting configured to join with a rail car brake line that is further in fluid communication with a brake of the rail car. If the air line inadvertently detaches from the brake line, the air circuit can trip the rail car brakes to impair movement of the rail car with the brakes.

In even another embodiment, the attachment can include an electrical junction box and a power cord configured to removably and electrically couple the electrical junction box, and a number of associated solenoids, to a power system of equipment to which the attachment is joined. The power cord can include a flex cable between certain plugs and boxes for easy replacement in case of damage or pinching of the cord.

In a further embodiment, the attachment can include a receiver coupled to the electrical junction box. The remote can include a transmitter in wireless communication with the receiver to convey signals from the various actuators input by an operator to control the various functions of the attachment.

In still a further embodiment, the attachment can include an indicator arm movably joined with the base. The indicator arm can be maintained in a retracted state before the rail car coupler on the attachment is secured to the rail car coupler on the rail car. The arm can extend to an extended state after the rail car couplers are joined. In the extended state, the indicator arm extends beyond a lateral side of the rail car, or generally past the width of the rail car. Accordingly, a spotter forward of the rail car can view the indicator arm in the extended state to confirm the rail car coupler of the attachment is secured to the rail car coupler on the rail car, and thus that the rail car can be moved by the equipment to which the attachment is joined.

In yet a further embodiment, the attachment can include an air horn in fluid communication with the air circuit. The air horn can sound when the first latch and second latch are connected or disconnected, or generally when the lock pin is adequately set to connect the rail car coupler or the attachment to a rail car coupler of a rail car.

In even a further embodiment, the attachment can include a light joined with the base and configured to emit illumination to indicate an electrical fault in the system on the attachment and/or electrical power satisfactorily powering the attachment elements. The light can be coupled to the electrical junction box.

In a further embodiment, a method is provided. The method can include coupling a base including a first rail car coupler having a first latch to a piece of mobile equipment; removably coupling one or more hydraulic lines or power cords between an air compressor mounted on the base to a hydraulic system or power system of the mobile equipment; powering the air compressor; pressurizing an air circuit in fluid communication with the air compressor; joining an air line, in fluid communication with the air circuit, with a rail car brake line that is further in fluid communication with a brake of the rail car; actuating a coupler latch solenoid joined with the air circuit to move a lock pin and lock or unlock the first latch relative to a second latch of a corresponding second rail car coupler on the rail car; providing a receiver adjacent the base; and removably mounting a remote in a cab of the mobile equipment. The remote can include a transmitter in wireless communication with the receiver, an emergency actuator configured to cause the brake of the rail car to actuate when the emergency actuator is manually actuated by an operator and/or a controlled stop actuator configured to cause the brakes of the rail car to be applied in a controlled manner via the remote when the controlled stop actuator is manually actuated by the operator.

The current embodiments provide a rail car mover attachment and method for efficient and safe movement of rail cars with different pieces of equipment. With the attachment, one piece of equipment can be temporarily used to move rail cars, then put to other uses with the attachment subsequently removed. Where the remote is included, this can simplify the wiring as well as reducing the dependency on the machine if another unit needs to be put in its place or if the equipment is updated. Where the attachment includes self-activating emergency brakes if power is lost or the attachment detaches from the equipment, an added level of safety is provided to prevent a runaway rail car. Where the attachment includes an air horn and/or light that automatically indicate a connected or unconnected condition of the rail car, the operator and others around the rail car can visually or audibly confirm the status of the attachment. In cases where a high volume compressor is utilized, the attachment is simplified and void of tanks that might be damaged and cause a dangerous situation.

These and other objects, advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
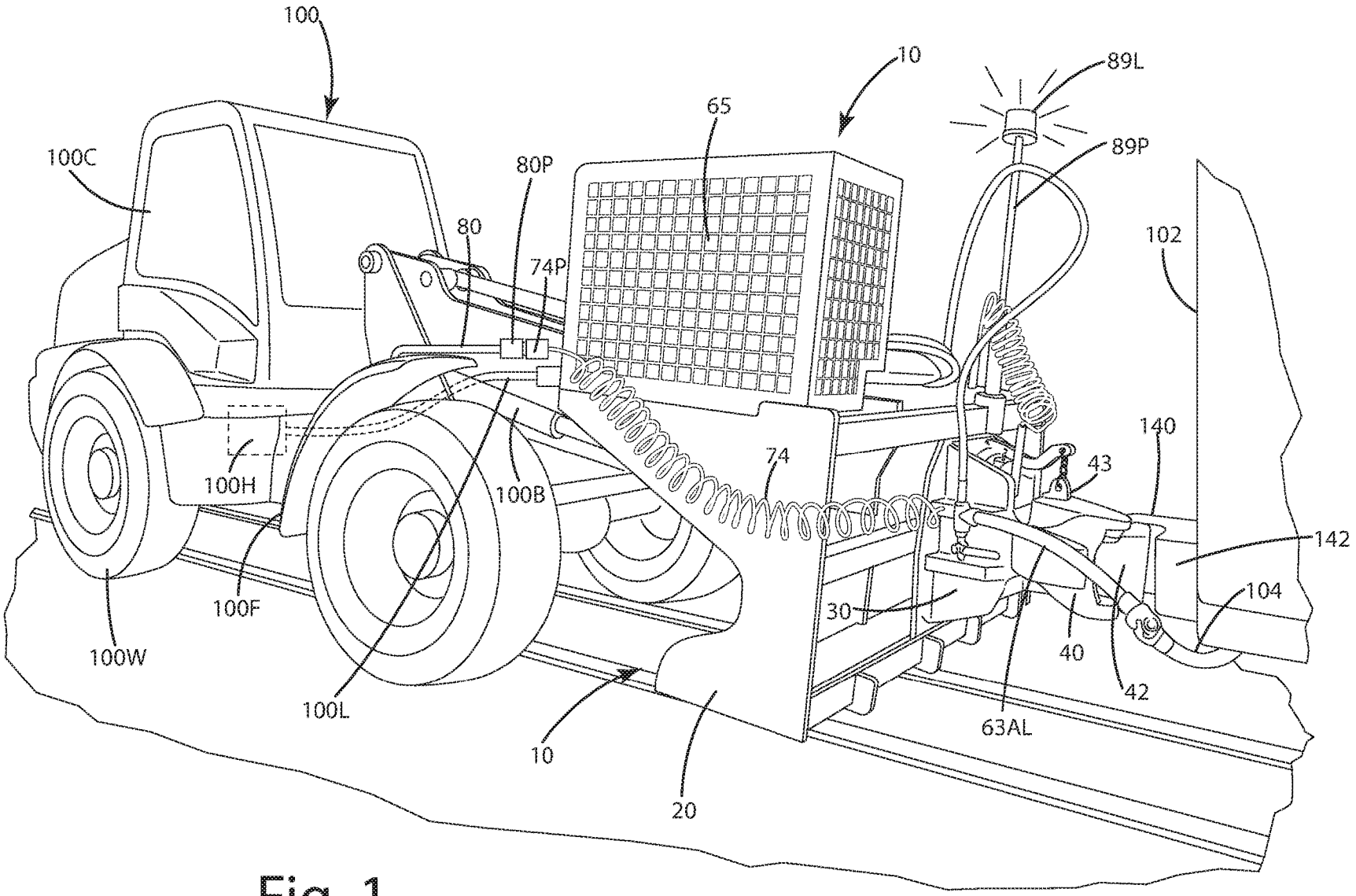
FIG. 1 is a perspective view of the rail car mover attachment of a current embodiment attached to a mobile machine.
Figure 2:
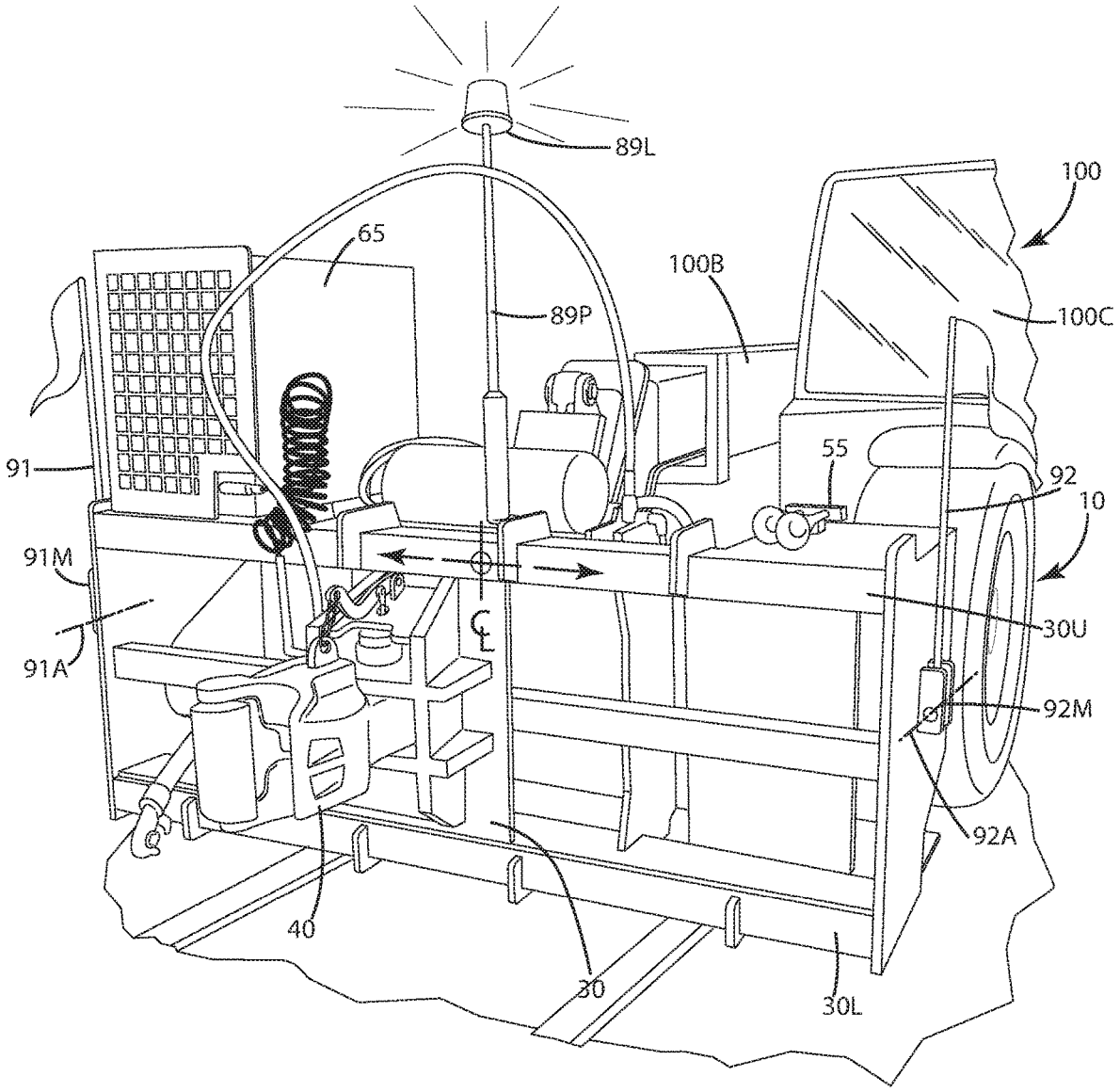
FIG. 2 is a front perspective of the rail car mover attachment with a rail car coupler.

A current embodiment of the rail car mover attachment is shown in FIGS. 1-10 and generally designated 10. The rail car mover attachment 10 can be joined with a mobile machine 100, which as shown can be in the form of a telehandler. Of course, other types of mobile equipment, such as payloaders, skid steers, tractors, forklifts or trucks can be outfitted to receive the attachment and function with it to move rail cars. The machine 100 can include a set of wheels 100W which are attached to a frame 100F. A cab 100C can be mounted to the frame. The machine 100 also can include a boom 100B, which can be a fixed or telescoping boom that is configured to raise and lower the attachment 10.

The rail car mover attachment 10 can include a base 20. The base can include one or more quick coupler flanges or plates 23 which can include recesses 23R that connect the base 20 to corresponding bars or features of the boom 100B. Optionally, the plates can include different types of configurations and shapes such that the base can be quickly coupled to and removed from booms of a variety of different pieces of equipment. Further optionally, the plates can be temporarily fastened to the base with bolts or other fasteners so that they can be quickly changed out, depending on the equipment to which the attachment is to be secured.

The attachment 10 can be configured to include a carriage 30 that is movably mounted in upper 30U and lower 30L frames. The carriage mount 30M, to which a first rail car coupler 40 is mounted, can slide back and forth and move laterally relative to a longitudinal axis or centerline CL of the base 20 to accommodate different positions of a rail car relative to the machine 100 and vice versa. The first rail car coupler 40 can be a standard rail car coupler with a latch 42 that rotates about an axis 42A. This latch can be secured in place so that the first rail car coupler 40 can join with and lock relative to a second rail car coupler 140 of a rail car 102 as shown in FIG. 1.

The first latch 42 can be secured in position such that the first rail car coupler 40 and second rail car coupler 140 are locked to one another via a locking pin 43. This locking pin 43 can be joined with or suspended from an armature 45 that rotates about an axis 45A. As shown, a chain 45C can join the armature 45 and the lock pin 43. The armature can further be joined with a link 46 that extends to an air chamber 50 which is in fluid communication with an air circuit 60 that is pressurized or otherwise has flow through it via operation of a compressor 65 that is mounted to the base 20. The air chamber 50 can be covered by an upper plate 50P, and opposing side plates 50S so that damage to it can be minimized. The link 46 can project through the upper plate 50P, through a slot defined by the plate.

This air compressor 65 can be mounted above the rail car coupler 40 and generally top the base. The air compressor can be mounted on the base adjacent a carriage as illustrated. Of course on other applications it can be mounted elsewhere on the base, but generally in a position so that it can be accessed and serviced. The air compressor can be a high-volume air compressor capable of outputting pressures of at least 90 PSI and a flow rate of at least 60 CFM. The air compressor 65 can provide fluid pressure to the air circuit 60 and its various components as described below. The air compressor 65 can be a hydraulic air compressor, such as a rotary screw or piston type hydraulic air compressor commercially available from Boss Industries of LaPorte, Ind. This hydraulic air compressor can be powered via a hydraulic system 100H onboard the machine. Hydraulic lines 100L can extend from the machine and can be connected to the air compressor to power and operate it. Alternatively, the air compressor can be an electric compressor joined with an electrical system 70 which is onboard the attachment and configured to be plugged into or otherwise coupled to an electrical system or power system 80 of the machine 100. In other cases however, the compressor 65 can be self-powered. For example, it can include an internal combustion engine such that it can generate sufficient pressure and flow rates for the various components of the circuit 60.

Figure 3:
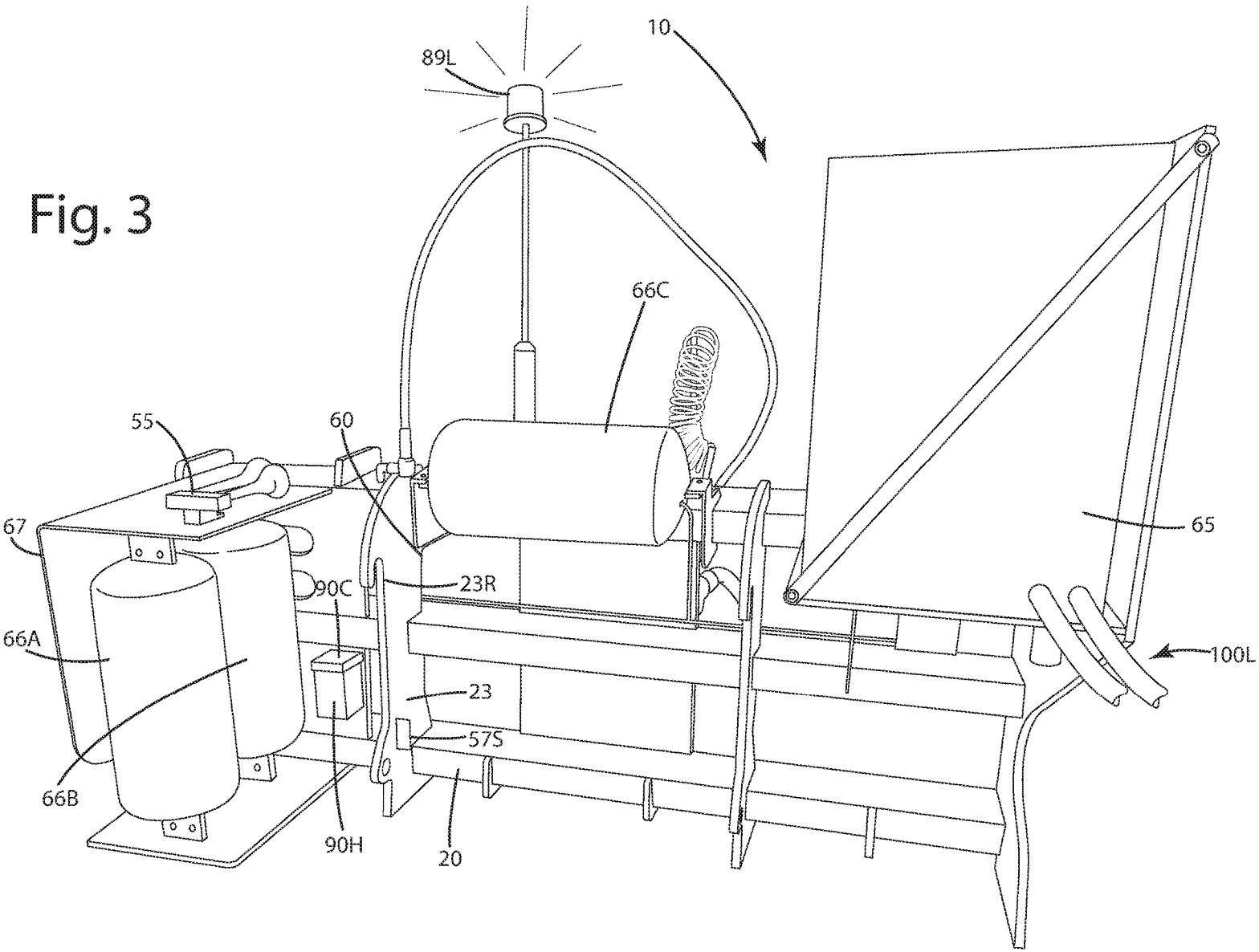
FIG. 3 is a rear perspective view of the rail car mover attachment with an air compressor and air tanks.
Figure 8:
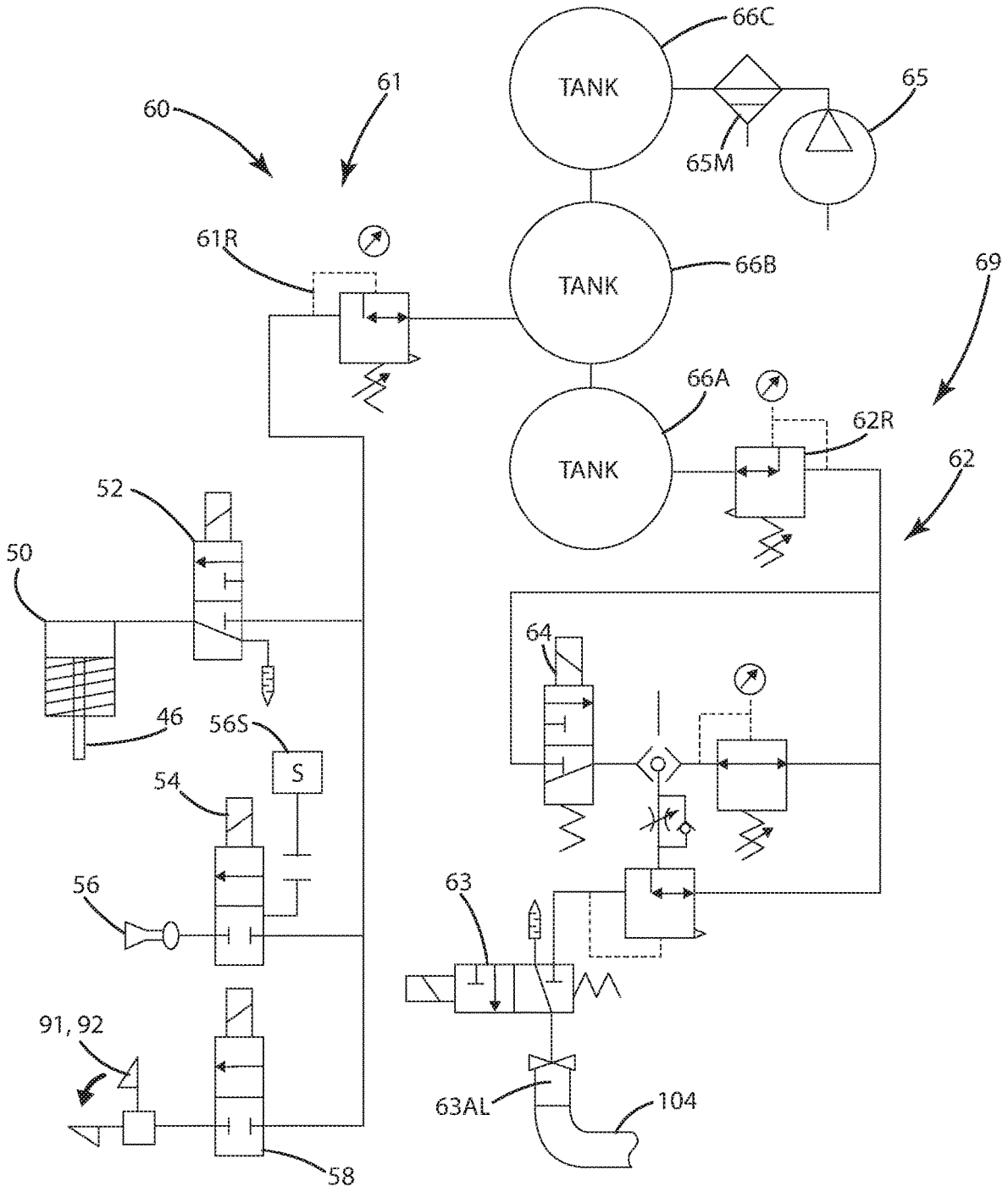
FIG. 8 is a schematic of an air circuit and components of the attachment.
Figure 9:
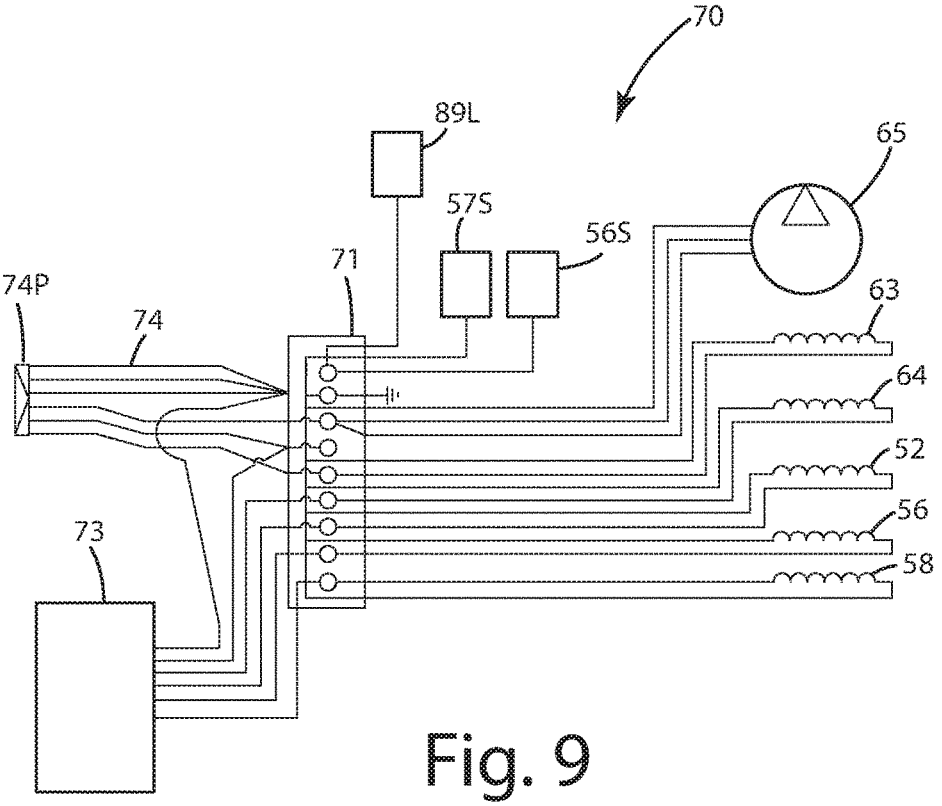
FIG. 9 is an electrical schematic of electrical components onboard the attachment.
Figure 10:
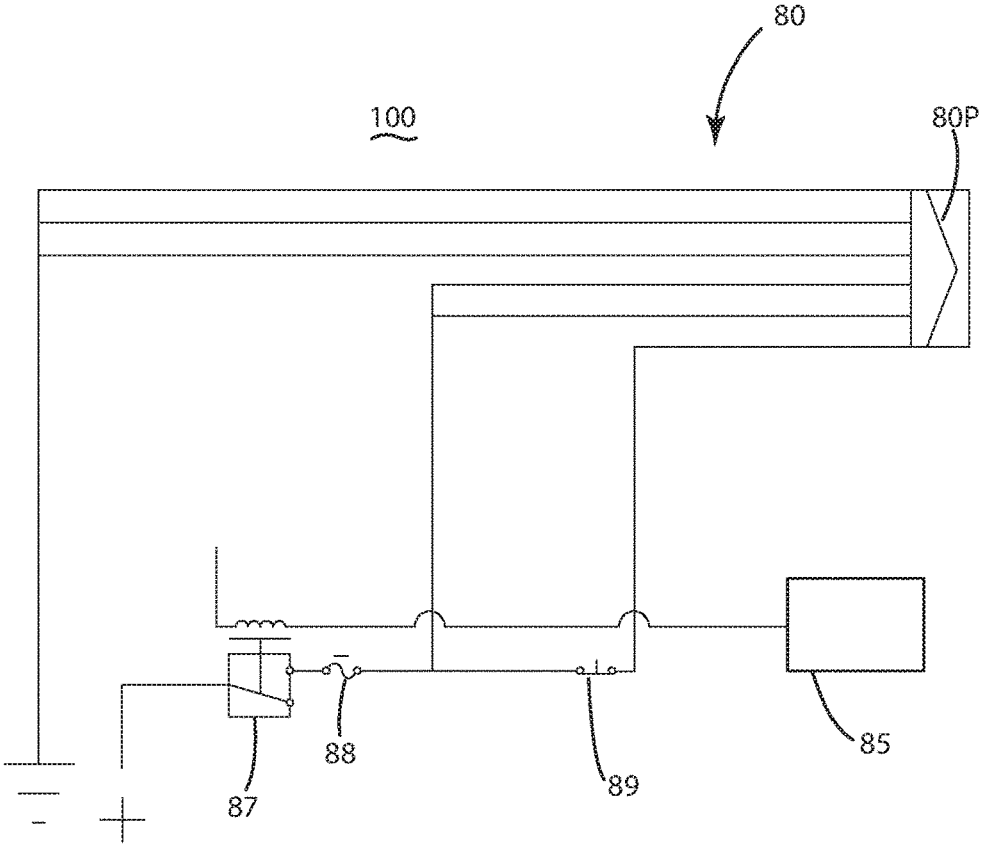
FIG. 10 is an electrical schematic of an electrical system onboard the machine to which the attachment is mounted.

As mentioned above, the attachment 10 can include an air circuit 60 that is plumbed to a number of different components as shown in FIGS. 3 and 8. These components can include a number of solenoids, regulators, bladders, tanks, fittings and other elements as described below. The attachment also can include an electrical circuit or system 80, as shown in FIG. 9, which can function in concert with the various components of the air circuit as described below.

Figure 6:
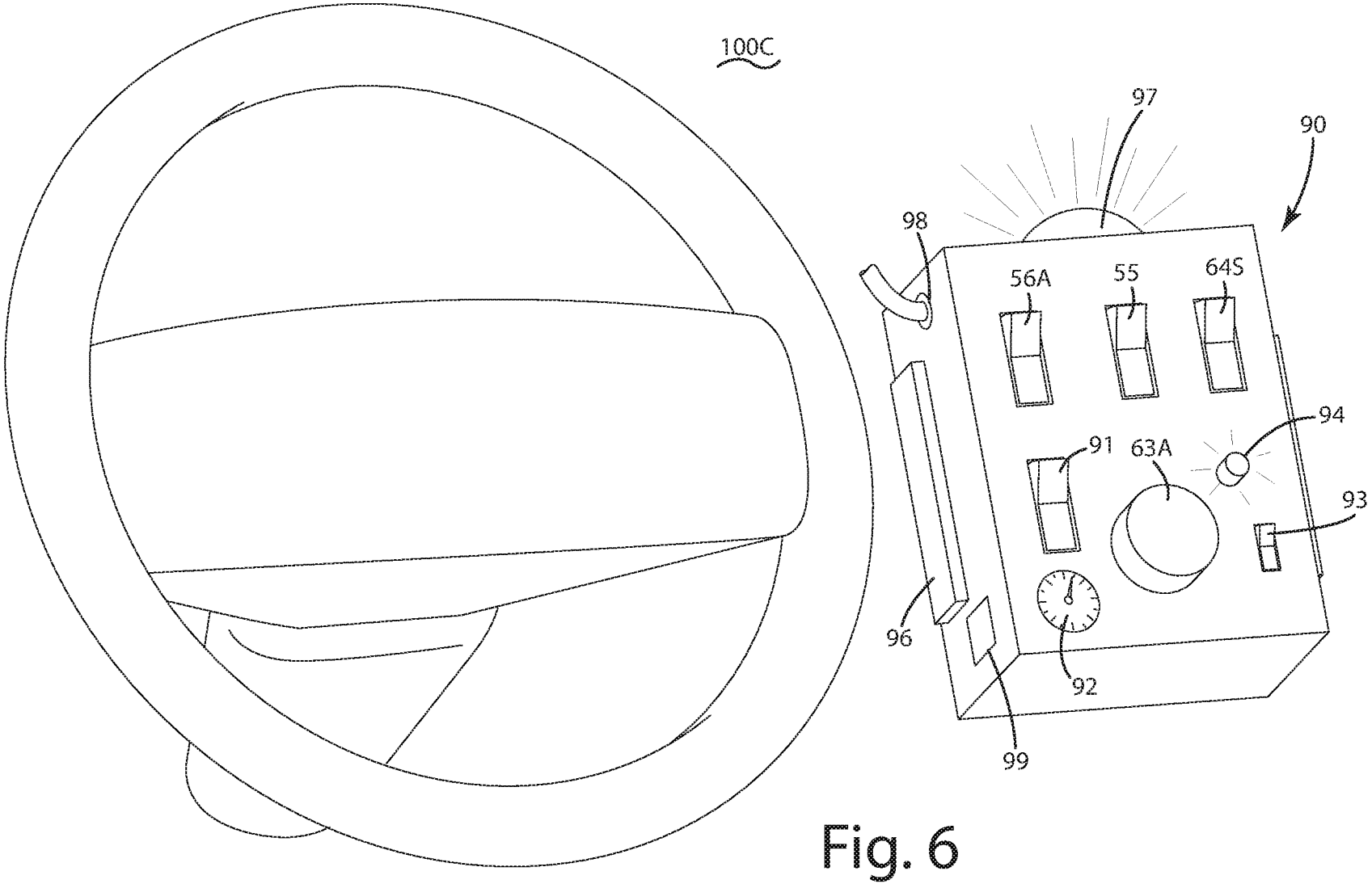
FIG. 6 is a perspective view of a remote of the attachment in a cab of the machine.

With reference to FIGS. 3 and 6, the attachment 10 can include one or more air tanks 66A, 66B and 66C mounted to the base 20. The tanks can be mounted in various locations. The base 20 can include protective shrouds 67 that can shield the tanks from accidental puncture or damage, such that they do not easily become disassociated from or damaged on the attachment 10. These tanks can be plumbed to the air circuit 60 and can be in fluid communication with the air compressor 65. The air compressor 65 can convey pressurized air to the tanks such that the tanks in operation can store a supply of that pressurized air for operating the various components of the attachment as described below. Although shown as including three tanks, more or fewer tanks can be included. Where the compressor 65 is a high-volume air compressor, the tanks can be eliminated such that the attachment is void of any such tanks, pressurized or not. The high-volume air compressor can supply adequate air pressure and flow on demand at all times to the various components of the attachment.

The air circuit 60, also referred to as a pneumatic system or pneumatic circuit, will now be described in more detail with reference to FIG. 8. There, the air compressor 65 can be plumbed in the air circuit 60 to the tanks 66A, 66B and 66C. A moisture trap 65M can be disposed between the air compressor 65 and the tanks to reduce moisture introduced into the air circuit 60. The air circuit can include one or more different branches dedicated to different components. The air circuit shown can include a first branch 61 and a second branch 62. Each of the branches can include separate pressure regulators 61R and 62R to regulate pressure to the respective components in the branches.

Figure 4:
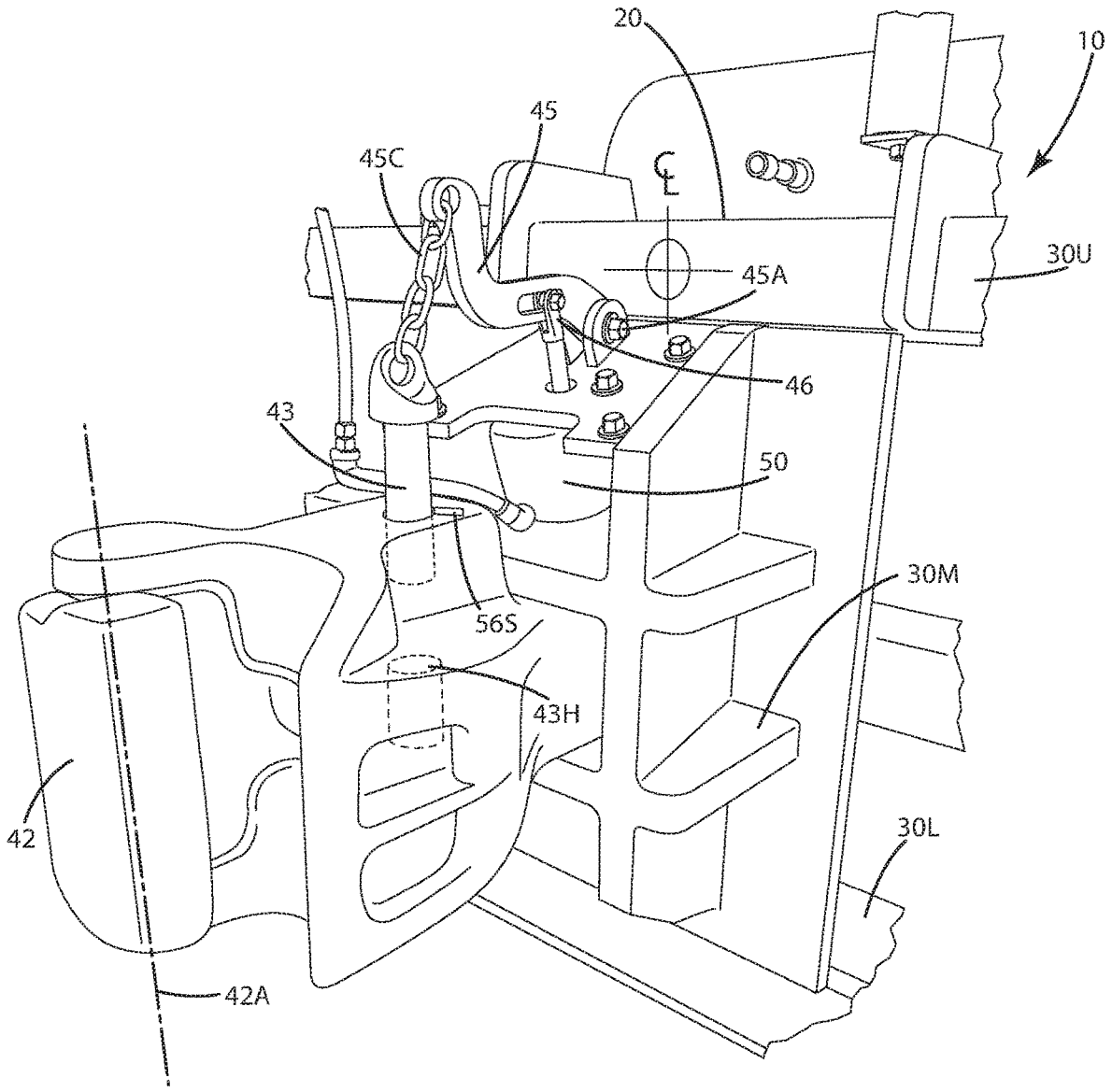
FIG. 4 is a perspective view of the rail car coupler with a locking pin in an unlocked mode.
Figure 5:
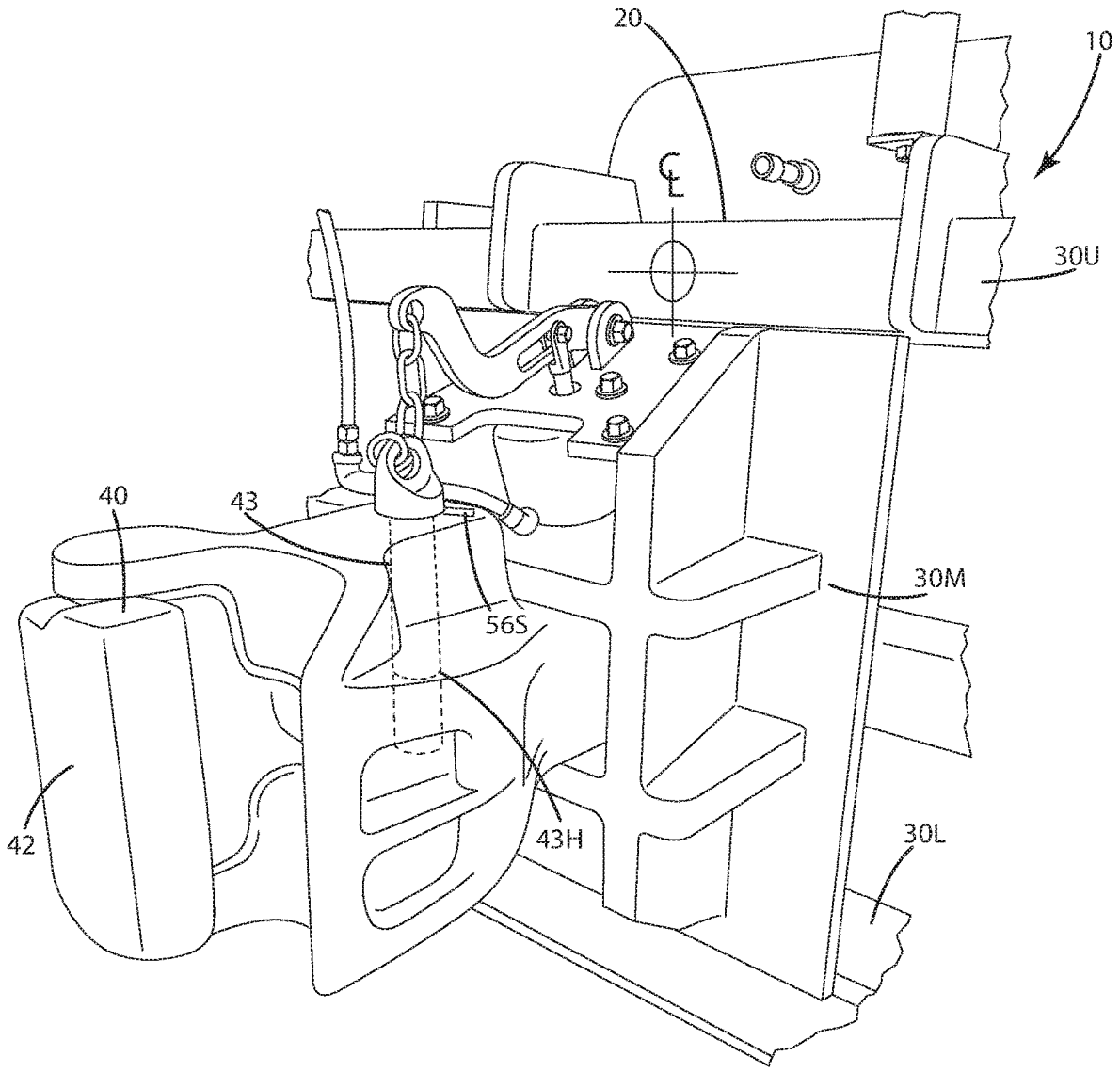
FIG. 5 is a perspective view of the rail car coupler with the locking pin in a locked mode.

The branches can include different solenoids and operating features of the attachment 10. For example, the first branch 61 can include a coupler latch solenoid 52, an air horn solenoid 54 and/or an indicator arm solenoid. The coupler latch solenoid 52 can regulate a source of pressurized air from the air circuit 60 to the air chamber 50 which in turn controls retraction and extension of the link 46. With reference to FIGS. 4 and 5, the lock pin 43 can default to the position shown in FIG. 5 such that the lock pin 43 normally is in the hole 43H. In this default position, the lock pin can fall into the hole 43H to lock the latch 42 in a locked mode relative to another latch 142 of a second rail car coupler 140. The coupler latch solenoid can be actuated by an operator, for example, using a remote 90 as described below such that the air chamber 50 fills with air from the air circuit, thereby moving the link 46 which in turn moves the armature 45 to withdraw the lock pin 43 from the lock pin hole 43H in the latch 42. In this manner, the latch 42 is thereby freed to move in and engage another latch 142 of the second rail car coupler 140 on the rail car 102. This can occur when the attachment is being used to join the first rail car coupler 42 to the second rail car coupler 140. It will be appreciated that the various movements and operation of the solenoid can be reversed or plumbed differently to move the locking pin into a locked mode and an unlocked mode and a variety of manners.

The attachment 10 optionally can be outfitted with an audible alarm, which as shown can be in the form of one or more horns 56. These horns can be plumbed into the air circuit 60 as shown in FIG. 8. There, the first branch 61 includes an air horn solenoid 54. This air horn solenoid 54 can be operated by an air horn actuator 56 with a remote 90 by an operator. When the solenoid 54 is moved to an open configuration, pressurized air from the air circuit can be omitted from the air horn 56 to indicate an audible alarm. This audible alarm can be sounded by the operator utilizing the remote 90, or automatically in other cases to indicate certain conditions of the attachment.

Optionally, the electrical system 70 can include a sensor 56S associated with the lock pin 46. When the lock pin is in the locked mode as shown in FIG. 5, the sensor 56S can detect this and actuate the solenoid automatically to sound the horn 56. Of course, the horn can be sounded in other circumstances, such as when the lock pin is not in a locked mode, or when the latch 42 becomes disassociated from the second latch 142, by moving the sensor to different locations or using additional sensors. In general, the air horn 56 can be in fluid communication with the air circuit 60 and can be configured to sound when the first latch and second latch are connected or disconnected, for example when the first rail car coupler 40 and second rail car coupler 140 are connected or disconnected, or when the lock pin is in a particular mode, such as a locked mode or an unlocked mode.

Figure 7:
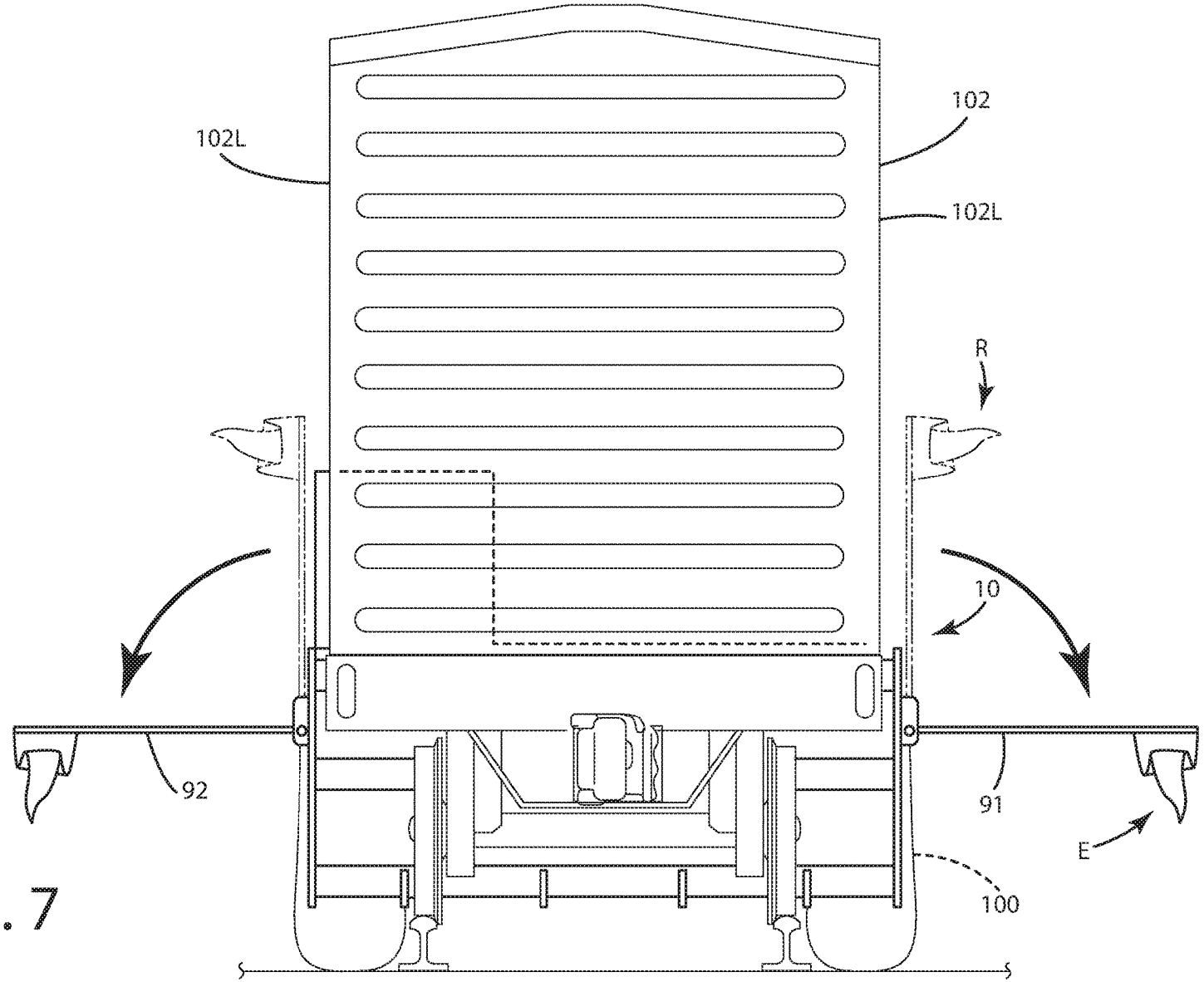
FIG. 7 is a front perspective view of indicator arms of the attachment visually indicating attachment of the rail car coupler of the attachment to a rail car coupler of a rail car.

As mentioned above, the first branch 61 can optionally include an indicator arm solenoid 58. This indicator arm solenoid 58 can be operably coupled to one or more indicator arms 91 and 92 that are mounted to the lateral sides of the base 20. These indicator arms 91 and 92 can be configured to be disposed in a retracted state R adjacent the base, or an extended state E, extending distally from the base, as shown in FIG. 7. When in the extended state, the indicator arms 91 and 92 can extend beyond the lateral sides 102L of the rail car 102 such that a spotter, forward of the rail car 102 can view the indicator arms in the extended state to confirm the first rail car coupler is secured to the second rail car coupler and thus the attachment is secured to the rail car in a satisfactory manner.

The indicator arms 91 and 92 can be mounted via mounts 91M and 92M and can rotate about respective axes 91A and 92A from the retracted state to the extended state and vice versa. These arms can be joined with a pneumatic operator that is in fluid communication with the indicator arm solenoid 58. In some cases, the solenoid 58 can be coupled to and/or in communication with the sensor 56S such that when the lock pin is in the locked mode, or the first rail car coupler and second rail car coupler are satisfactorily joined with one another, the indicator arms will lower from the retracted state R (in broken lines) to the extended state E (in solid lines) as shown in FIG. 7. Pressure from the air circuit 60 can be used to move the indicator arms in a particular direction. Although not shown, the indicator arms also can be outfitted with biasing elements such as springs or pulleys that can move the indicator arms back to a default position after having been pneumatically operated via the air circuit 60. Optionally, the arms can be remotely operated via the remote control 90 and a designated actuator 93 which can operate the indicator arm solenoid 58 via the electrical system 70.

As mentioned above, the air circuit 60 also can include a second branch 62, which can include its own set of components, such as an emergency stop solenoid 63 as well as a momentary stop solenoid 64. This branch also optionally can include other pneumatic components such as a shuttle valve 62S and a mini pressure regulator 62P. The solenoids in this second branch, like the ones in the first branch, can be mounted to the base and generally in fluid communication with the air circuit or pneumatic system 60. The emergency stop solenoid 63, as well as all the other solenoid herein, generally also can be in electrical communication with an electric junction box 71 as shown in FIG. 9.

The emergency stop solenoid 63 can be configured to abruptly charge the brakes of the rail car 102 when an emergency brake actuator 63 on the remote 90 is manually operated by an operator. Thus, in certain situations where the rail car appears to be about to move unintentionally or excessively, an operator with access to the remote can strike the actuator 63A of the remote 90 and actuate the rail car brakes and stop that car or otherwise cease its movement. As can be seen in FIGS. 1 and 8, the attachment 10 can include an airline 63AL that can be in fluid communication with the air circuit 60 via the solenoid 63. The airline 63AL can project forwardly adjacent the first rail car coupler 40 of the attachment 10, toward the rail car 102. The air line 63AL can include a fitting that joins it with a brake line 104 of the rail car. The brake line 104 can be in fluid communication with one or more brakes of the rail car 102.

Optionally, the emergency stop solenoid 63 can be configured so that it automatically causes the railcar brakes to actuate on the rail car in situations where electrical power is lost to the attachment or the attachment becomes dislodged from the machine. For example, the attachment can include another sensor 57S that is near the quick coupler 23. The sensor 57S can sense when the quick coupler 23 is dislodged from the machine. The sensor 57S can be coupled to the electrical system 70 and thus the solenoid 63. When the disassociation is sensed, the sensor, and/or a related processor or circuit, can automatically actuate the emergency brake solenoid 63 to dump air from the air circuit, thereby actuating the air brakes.

Generally, the brakes can be activated when the air is released from the air circuit 60, for example, when the airline 63AL decouples from the brake line 104. In some applications, it can take 90 PSI to release the rail car brakes. If power is lost to the solenoid 63, all the air is dumped to exhaust, and the brakes abruptly are applied on the railcar to bring it to an emergency stop quickly. Further, if the coupler 23 is disassociated from the machine, the power cord 74 will be pulled and eventually unplugged, which will terminate the power supply. As a result, the solenoid 63 will dump and exhaust the air from the air circuit and accordingly apply the brakes on the railcar.

The second branch 62 of the air circuit 60 also can include a momentary brake solenoid 64 that can be mounted to the base 20 and also in fluid communication with the air line 63AL and thus the brake line 104 and brakes of the rail car. This momentary brake solenoid 64 can be configured to actuate the brakes of the rail car in a controlled manner to provide a controlled stop of the rail car. This solenoid 64 can be in electrical communication with the controlled stop actuator 64S actuator on the remote 90 so the operator can remotely operate that solenoid and thus actuate the brakes to provide the controlled stop. Under a controlled stop, the solenoid can slowly decrease air pressure in the air circuit, releasing the air at a slower rate than in the emergency stop mode noted above, and thus the pressure in the brake line, to slowly and/or controllably bring the rail car to a stop with the rail car brakes.

As mentioned above, the attachment 10 includes the electrical circuit or system 70 as shown in FIG. 9. This electrical system 70 can include an electrical junction box 71 which can be coupled via one or more wires or cords to the air compressor 65. The electrical junction box 71 also can be electrically coupled to the emergency stop solenoid 63 as well as the controlled stop solenoid 64. In addition, this electrical junction box 71 can be coupled to the lock pin solenoid 52, the air horn solenoid 56 and the indicator arm solenoid 58, to thereby control each of those solenoids and the conveyance of pressurized air through those solenoids from the air circuit.

The electrical junction box 71 can be coupled to a power cord 74 which includes a plug 74P. This plug 74P can be configured to join with a plug 80P of an electrical system 80 of the machine 100. This electrical power system 80 optionally can include a main power relay 87, a fuse 88 and battery keyed power 85. The system also can include an emergency stop switch 89, manually operable by an operator, which can be hardwired or otherwise electrically coupled to the emergency stop solenoid 63 such that that solenoid can be activated to exhaust air from the air circuit and thereby automatically activate the brakes of the rail car.

The electrical system 70, in particular the electrical junction box 71 also can be electrically coupled to a receiver 73 which can be configured to receive and in some cases send signals from the remote 90. Transmission of the signals can be wireless, in some cases via radio frequency waves, Wi-Fi, Bluetooth or other wireless technologies depending on the application. The receiver 73 can include a processor, circuit board and various other transceiver components.

The electrical system and solenoids can be controlled via the remote 90. As shown in FIG. 6, the remote can be a completely self-contained, portable remote. The remote can include its own power source 99 optionally in the form of batteries. Alternatively, the remote can include a separate power cord 98 which can be plugged into a charging or USB port in the machines to power the remote. The remote communicates with the attachment 10 via the electrical system 70 through the receiver 76. The remote 90 can communicate with the receiver 72, sending signals generated by manual input to the actuators associated with the remote. The remote 90 can be held in a mount 96 that is mounted in the cab 100C of the machine 100, distal from the attachment 10.

Optionally, as shown, the remote 90 can include multiple physical actuators, which can be in the form of toggles, switches and buttons. In other cases, the remote can include a touchscreen and/or can be in the form of a tablet so that an operator can use it for inputting commands to operate the various components of the attachment.

As mentioned above, the remote can be portable relative to the attachment. When the remote 90 is not to be mounted in a particular machine, the remote 90 can be placed in a remote holder 90H which is mounted to the base as shown in FIG. 3. This holder 90H can be in the form of a box and can include a closure 90C, which can optionally be in the form of a hinged door that secures the remote to or in the holder. In this manner, the holder can store the remote 90 when not in use. The remote also can be easily found in the holder when it is desired to attach the attachment to a machine and use the remote. Of course, in some cases, the remote 90 can be tethered to the receiver via a tether cord so that the remote cannot be easily removed from the attachment. Where the remote is wireless however, this greatly simplifies the wiring as well as reduces the dependency on the machine if another unit needs to be put in its place or if updating the machine.

As mentioned above, the remote 90 can include multiple actuators. For example the remote can include a controlled stop actuator 64S, a latch coupler lock pin actuator 55, a horn actuator 56R as well as an emergency brake actuator 63A, which can be in the form of a smack button. In some cases, the actuator can include an indicator light 94 which can indicate to the operator that the system is electrically charged and/or the solenoids all have appropriate function. They also can include an arm actuator 93 to operate the indicator arms. In some cases, the remote can include an air pressure gauge 92, which can indicate the pressure in the air circuit 60 on board the attachment so that a user can monitor the same. All of these actuators can be manually actuated by the operator to carry out the intended function.

Optionally, the attachment 10 can further include a light 89L. This light can be mounted to a pole 89P and otherwise coupled to the electrical junction box 71. This light can be controlled by an actuator 91 on the remote. This light can be turned on to emit illumination to indicate that the attachment is in use. In other cases, the light can automatically turn on when the electrical system is adequately powered. The light 89L optionally can be configured so that when the power system 70 of the attachment is not powered, the light does not illuminate, so a user can readily confirm the lack of power. In some cases, the light can indicate an electrical fault in the power system powering the attachment 10. In other cases, the light can indicate that electrical power satisfactorily powers the electrical system of the attachment.

A method of using the rail car mover attachment 10 will now be described. On a high level, the method can include coupling the base 20 to the equipment 100; removably coupling a power cord 74 between an electrical junction box on the base to a power system of the equipment 100; powering the air compressor 65 via a hydraulic line coupled to a hydraulic system of the equipment 100; pressurizing the air circuit 60 with the air compressor; joining the air line 63AL with a brake line 104 of a rail car 102 that is further in fluid communication with a brake of the rail car; optionally actuating a coupler latch solenoid 52 joined with the air circuit to move a lock pin 43 and lock or unlock the first latch 42 relative to a second latch 142 of a corresponding second rail car coupler 140 on the rail car; providing a receiver adjacent the base; and removably mounting the remote 90 in a cab 100C of the equipment.

In coupling the base 22 the equipment 100, the quick coupler 23 of the base can be joined with the boom 100B of the machine. The sensor 57S optionally can confirm adequate coupling of the attachment to the boom and thus the machine, optionally sending a signal through the electrical circuit 70 to the receiver and remote. After the attachment 10 is joined with the machine 100, the power cord 74 can be secured to the electrical system 80 of the machine. In particular, the plugs 74P and 80P can be joined. The power cord can be constructed from flexible cord so that they can easily be manipulated or bent, and quickly replaced if damaged. The portable remote 90 can be removed from the remote holder 90H on the attachment and placed or removably installed in the cab 100C of the machine 100. In some cases, the remote 90 can be installed in the bracket 96 within the cab 100C.

With the power cord connected to the electrical system and generally to the electric junction box 71, the system can be powered. The air compressor can be connected via one or more hydraulic lines 100L to a hydraulic system 100H of the equipment. When the hydraulics of the equipment are operated, the air compressor 65 can begin to produce pressurized air in the air circuit 60. The amount of pressure in the air circuit 60 can be output to the air pressure gauge 92 on the remote 90 so that the operator can monitor the air pressure and confirm that the air circuit is indeed being pressurized for its intended functionality. Optionally, the electrical system can operate a fan in the air compressor for cooling components of the air compressor.

The operator of the machine 100 can drive the machine with the attachment secured to it toward a rail car 102. The operator can generally align the first rail car coupler 40 with the second rail car coupler 140 of the rail car 102. If these do not perfectly align, the first rail car coupler 40 can be moved laterally relative to the centerline or longitudinal axis of the attachment with the carriage mount 30 moving in the upper and lower tracks 30U and 30L. After the couplers are properly aligned, the operator can drive the attachment toward the rail car such that the latches 42 and 142 engage to one another. When the latches are adequately aligned, the lock pin drops into the lock hole to lock the couplers to one another. The operator can connect the airline 63AL to the brake line 104 of the rail car 102. When this occurs, the air pressure in the circuit 60 can cause the brakes of the rail car 102 to release so that the rail car can be rolled or otherwise moved on the tracks. The pressurized air from the circuit can be conveyed to the brakes through one or more of the solenoids 63, 64.

When the lock pin 43 is adequately in place and the latches of the rail car couplers are joined, optionally, the horn 55 can sound via air passing through the air horn solenoid as described above. In addition, where included, the indicator arms can be charged via the indicator solenoid 58 being operated by the arm actuator 93. In turn, the indicator arms 91 and 92 as shown in FIG. 7 can move from the retracted state R to the extended state E so that a spotter can view and understand that the attachment 10 is adequately connected to the rail car for movement.

When the attachment is adequately attached, the operator can drive the machine, pushing or pulling the rail car 102 to a desired location. When the attachment is in use and is moving the rail car, the operator can control the function of the brakes via the emergency brake actuator 63A or the controlled stop actuator 64S of the remote 90 which communicates with the receiver and thus the electrical system 70 of the attachment as described above. If the attachment 10 becomes detached from the machine, the sensor 57S detects this and can actuate the emergency stop solenoid 63 such that the brakes on the rail car are abruptly applied to stop the rail car movement.

After the rail car has been adequately moved, the attachment can be decoupled from the rail car such that the first rail car coupler detaches from the second rail car coupler. The decoupling can be facilitated by operating the latch coupler lock pin so that the pin disengages the first latch. The lock pin can withdraw from the lock pin hole as described above via movement of the armature with pressurized air in the circuit controlled via the lock pin solenoid. With the pin in such an unlocked mode, the first latch can disengage the second latch to release the rail car from the attachment. The airline 63AL also can be decoupled from the brake line 104 of the rail car. When this occurs, the decrease in pressure in the brake line can actuate the brakes of the rail car so it is immovable.

The attachment 10 can be readied for its next use or detached from the machine. Where it is detached from machine, the remote can be placed in the remote holder as described above.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to" or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law, including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A rail car mover attachment comprising:

a base including a carriage including a first rail car coupler having a first latch, the first rail car coupler movably mounted relative to the carriage so that the first rail car coupler can move laterally relative to a longitudinal axis of the base;

a lock pin movably mounted relative to the first rail car coupler, the lock pin being moveable relative to the first latch to lock the first latch relative to a second latch of a corresponding second rail car coupler on a rail car in a locked mode;

an air compressor mounted on the base adjacent the carriage;

an air circuit in fluid communication with the air compressor and configured to convey pressurized air from the air compressor;

a coupler latch solenoid joined with the air circuit and operably coupled to the lock pin to move the lock pin relative to the first latch;

an air line in fluid communication with the air circuit and configured to join with a rail car brake line that is in fluid communication with a brake of the rail car;

an electrical junction box coupled to a power cord that is configured to removably and electrically couple the electrical junction box to a power system of equipment to which the attachment is joined;

a receiver mounted to the base and coupled to the electrical junction box; and a remote removably mountable in a cab of the equipment, the remote including an emergency actuator configured to cause the brake of the rail car to actuate when the emergency actuator is manually actuated by an operator, a lock pin actuator configured to cause movement of the lock pin associated with the first latch when the lock pin actuator is manually actuated by the operator, and a controlled stop actuator configured to cause the brake of the rail car to be applied in a controlled manner via the remote when the controlled stop actuator is manually actuated by the operator.

2. The rail car mover attachment of claim 1, wherein the air compressor is a hydraulically powered high volume air compressor and the attachment is void of any pressurized air tanks in fluid communication with the air compressor.

3. The rail car mover attachment of claim 1 comprising:

an air horn in fluid communication with the air circuit, wherein the air horn is configured to sound when the first latch and second latch are at least one of connected and disconnected.

4. The rail car mover attachment of claim 2 comprising:

a light joined with the base and configured to emit illumination to indicate at least one of an electrical fault and an electrical power satisfactorily powering the attachment, wherein the light is coupled to the electrical junction box.

5. The rail car mover attachment of claim 1 comprising:

an indicator arm movably joined with the base, the indicator arm configurable in a retracted state before the first rail car coupler is secured to the second rail car coupler, and an extended state after the first rail car coupler is secured to the second rail car coupler, wherein in the extended state, the indicator arm extends beyond a lateral side of the rail car such that a spotter forward of the rail car can view the indicator arm in the extended state to confirm the first rail car coupler is secured to the second rail car coupler.

6. The rail car mover attachment of claim 5, wherein the indicator arm is joined with an arm actuator in fluid communication with the air circuit such that air from the air circuit causes transition of the indicator arm from the retracted state to the extended state.

7. The rail car mover attachment of claim 1 comprising:

an emergency stop solenoid mounted to the base and in fluid communication with the air circuit and electrical communication with the electrical junction box, the emergency stop solenoid configured to abruptly actuate the brake of the rail car when the emergency actuator is manually actuated by the operator.

8. The rail car mover attachment of claim 1 comprising:

a lock pin solenoid mounted to the base and in fluid communication with the air circuit and an air chamber, the lock pin solenoid in electrical communication with the electrical junction box, wherein the lock pin solenoid is configured to selectively convey air to an air chamber so as to move the lock pin to an unlocked mode from the locked mode.

9. The rail car mover attachment of claim 8 comprising:

a momentary brake solenoid mounted to the base and in fluid communication with the air circuit and the brake line, the momentary brake solenoid in electrical communication with the electrical junction box, the momentary brake solenoid configured to actuate the brake of the rail car in a controlled manner when the controlled stop actuator is manually actuated by the operator.

10. The rail car mover attachment of claim 9, wherein the remote includes a transmitter in wireless communication with the receiver to provide input through the electrical junction box and control at least one of the momentary brake solenoid and the lock pin solenoid.

11. The rail car mover attachment of claim 1, wherein the remote includes a transmitter in wireless communication with the receiver joined with the base to provide input in response to manual activation of the remote by the operator.

12. The rail car mover attachment of claim 1 comprising:

a horn solenoid mounted to the base and in fluid communication with the air circuit and in electrical communication with the receiver; and a horn in fluid communication with the horn solenoid.

13. The rail car mover attachment of claim 12, wherein the horn solenoid sounds the horn when the lock pin locks the first latch relative to the second latch.

14. The rail car mover attachment of claim 12, wherein the horn solenoid sounds the horn when the lock pin unlocks the first latch relative to the second latch.

15. A rail car mover attachment comprising:

a base including a first rail car coupler having a first latch;

a lock pin movably mounted relative to the first rail car coupler;

an air compressor mounted on the base;

an air circuit in fluid communication with the air compressor and configured to convey pressurized air;

a coupler latch solenoid joined with the air circuit and operably coupled to the lock pin to move the lock pin relative to first latch to at least one of couple and uncouple the first rail car coupler to a corresponding second rail car coupler on a rail car;

an air line in fluid communication with the air circuit and configured to join with a brake line of a rail car that is further in fluid communication with a brake of the rail car;

a power cord coupled to an electrical junction box mounted to the base, the power cord configured to electrically couple the electrical junction box to a power system of equipment to which the attachment is joined; and a remote removably mountable in a cab of the equipment, the remote in communication with the electrical junction box, the remote including an emergency actuator configured to cause the brake of the rail car to actuate when the emergency actuator is manually actuated by an operator, and a controlled stop actuator configured to cause the brakes of the rail car to be applied in a controlled manner via the remote when the controlled stop actuator is manually actuated by the operator.

16. The rail car mover attachment of claim 15 comprising:

an emergency stop solenoid mounted to the base and in fluid communication with the air circuit and electrical communication with the electrical junction box, the emergency stop solenoid configured to abruptly charge the brake of the rail car when the emergency actuator is manually actuated by the operator.

17. The rail car mover attachment of claim 16 comprising:

a momentary brake solenoid mounted to the base and in fluid communication with the air circuit and the brake line, the momentary brake solenoid in electrical communication with the electrical junction box, the momentary brake solenoid configured to charge the brake of the rail car in a controlled manner when the controlled stop actuator is manually actuated by the operator.

18. The rail car mover attachment of claim 15 comprising:

an indicator arm movably joined with the base, the indicator arm configurable in a retracted state before the first rail car coupler is secured to the second rail car coupler, and an extended state after the first rail car coupler is secured to the second rail car coupler, wherein in the extended state, the indicator arm extends beyond a lateral side of the rail car such that a spotter forward of the rail car can view the indicator arm in the extended state to confirm the first rail car coupler is secured to the second rail car coupler, wherein the indicator arm is joined with an arm actuator in fluid communication with the air circuit such that air from the air circuit causes transition of the indicator arm from the retracted state to the extended state.

19. A method of using a rail car mover attachment, the method comprising:

coupling a base including a first rail car coupler having a first latch to a piece of mobile equipment;

removably coupling a power cord to a power system of the mobile equipment;

powering an air compressor;

pressurizing an air circuit in fluid communication with the air compressor;

joining an air line, in fluid communication with the air circuit, with a rail car brake line that is in fluid communication with a brake of the rail car;

providing a receiver adjacent the base; and removably mounting a remote in a cab of the mobile equipment, the remote including a transmitter in wireless communication with the receiver, an emergency actuator configured to cause the brake of the rail car to actuate when the emergency actuator is manually actuated by an operator, and a controlled stop actuator configured to cause the brakes of the rail car to be applied in a controlled manner via the remote when the controlled stop actuator is manually actuated by the operator.

20. The method of claim 19 comprising:

actuating a coupler latch solenoid joined with the air circuit to move a lock pin relative to the first latch so that the lock pin unlocks the first latch relative to a second latch of a corresponding second rail car coupler on the rail car.

* * * * *